United States Patent [19]

Padin

[11] Patent Number: 4,850,564

[45] Date of Patent: Jul. 25, 1989

[54] WINDPROOF UMBRELLA HOLDER

[76] Inventor: Gilberto Padin, 4200 SW. 3rd St., Miami, Fla. 33134

[21] Appl. No.: 248,940

[22] Filed: Sep. 26, 1988

[51] Int. Cl.[4] ..... E04H 17/22

[52] U.S. Cl. ..... 248/533; 248/156; 248/545; 52/157

[58] Field of Search ..... 248/530, 532, 533, 156, 248/545, 96; 52/157

[56] References Cited

U.S. PATENT DOCUMENTS

| | | | |
|---|---|---|---|
| 1,736,177 | 11/1929 | Snook . | |
| 2,453,565 | 11/1948 | Barden | 248/156 X |
| 2,538,118 | 1/1951 | Miller | 248/156 X |
| 2,849,249 | 8/1958 | Fridolph | 403/376 |
| 4,131,122 | 12/1978 | Brooks | 248/532 X |

*Primary Examiner*—Alvin C. Chin-Shue
*Attorney, Agent, or Firm*—J. Sanchelima

[57] ABSTRACT

A holder for umbrellas having an elongated and straight handle that have cylindrical receiving assembly for receiving said umbrella handle. A helical assembly having an upper termination including a threaded portion for cooperatively mating with a threaded opening of the receiving assembly and a lower termination with a screw member that is driven in the ground by easily applying a torque through a stabilizing base member, having substantially a flat and round shape, that is removably sandwiched between the cylindrical receiving assembly and the helical assembly. The base member includes a central square opening sufficiently large to permit the upper threaded termination through and snuggly housing a nut.

3 Claims, 2 Drawing Sheets

WINDPROOF UMBRELLA HOLDER

BACKGROUND OF THE INVENTION

1. Field of the Invention

The present invention relates to umbrella holders, and more particularly, to such holders that can be removably attached to the ground to withstand wind and other forces tending to remove the umbrella from its location.

2. Description of the Related Art

Not infrequently the wind causes a beach umbrella to fly away before its owner can catch it or otherwise take whatever action is necessary to keep it in place. Typically, a user tries to bury the umbrella handle as deep as possible with the consequent reduction of the effective height of the umbrella. If stones or other heavy objects are used around the area where the handle is buried, shade space is wasted.

Also, typically umbrellas are buried in the sand robbing some of the height. This reduces the available space under protection. With the present invention the end of the umbrella handle is always above the ground level.

Applicant believes that the closest reference corresponds to U.S. Pat. No. 1,736,177 issued to C.G. Snook. It differs from the present invention because it does not provide for means to transmit a torque to drive screw member 19. Also, it would not work with conventional umbrella handles, but rather, it requires a specific handle design.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a holder for umbrellas that is effective and volumetrically efficient.

It is another object of this present invention to provide such a holder that can be easily disassembled and transported.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
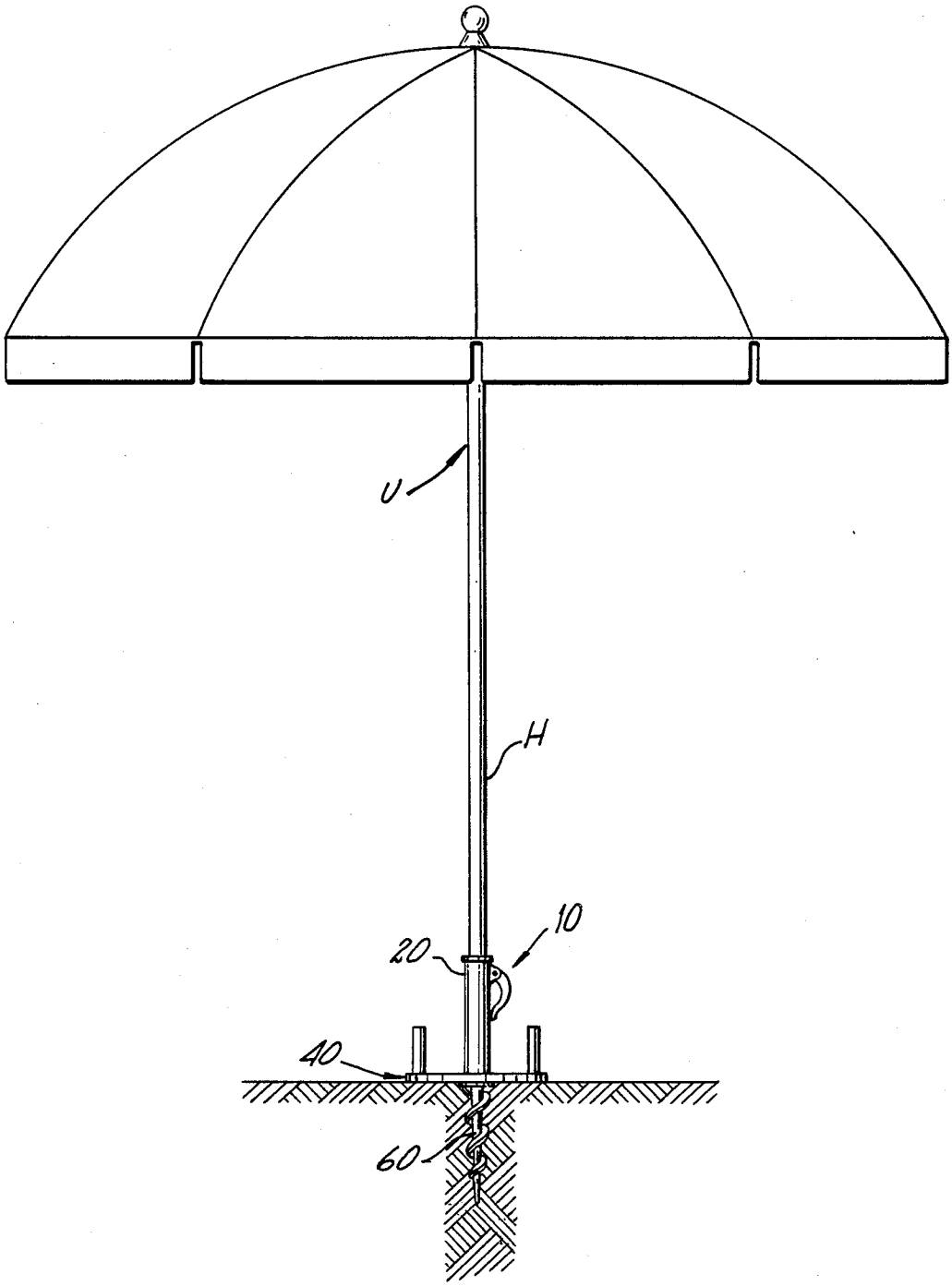
FIG. 1 represents a beach umbrella with the windproof holder affixed to the ground and holding the umbrella.

Referring now to FIG. 1, where the present invention is generally referred to with numeral 10, it can be observed that is basically includes a receiving housing assembly 20, flat base assembly 40 and helical assembly 60. Handle H of umbrella U is received by receiving housing assembly 20 that keeps it in place.

Figure 2:
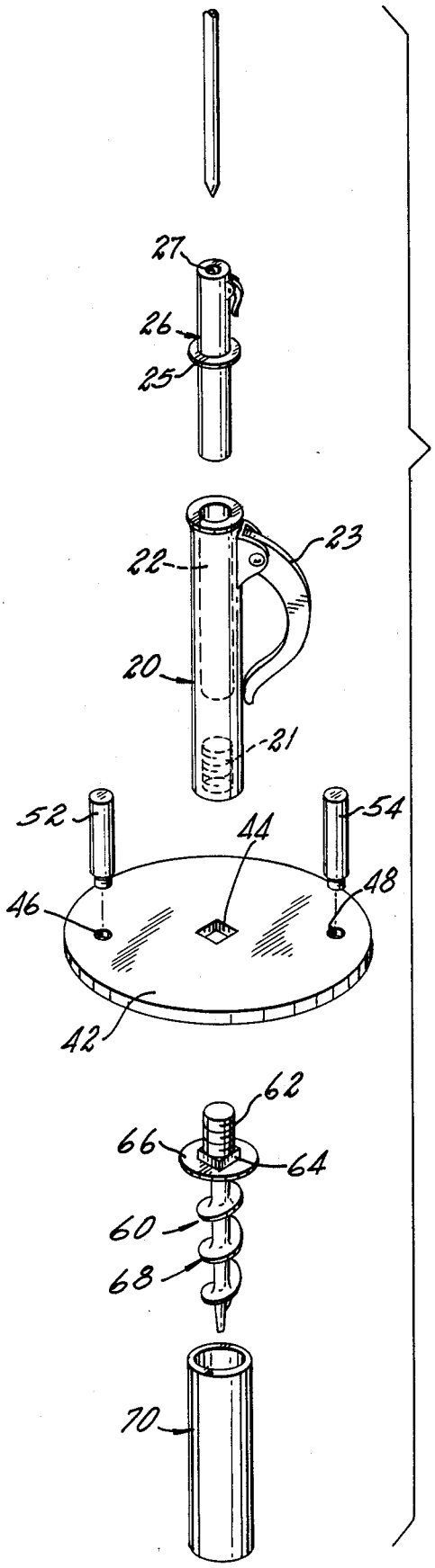
FIG. 2 shows an exploded view of the holder.
Figure 3:
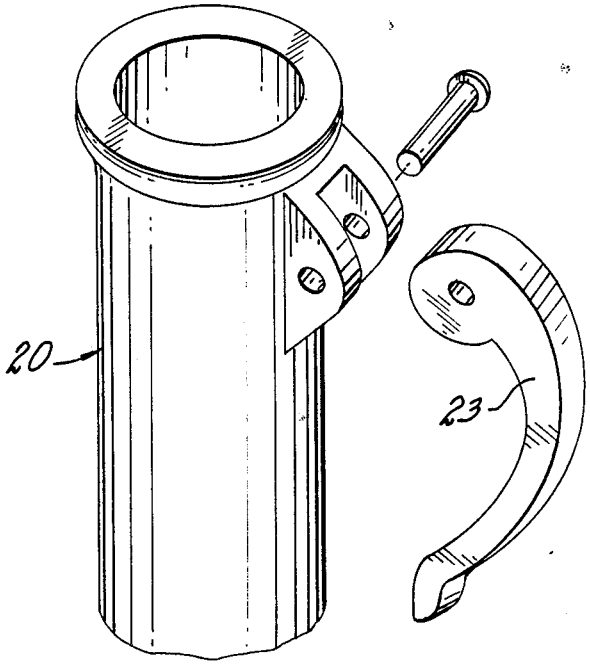
FIG. 3 illustrates an enlarged view of the receiving housing.

As it can be best seen from FIG. 2, holder 10 includes receiving housing assembly 20 that has substantially a cylindrical shape with its upper end having a sufficiently long axial cavity 22 of a predetermined diameter that in turn cooperatively receives conventional umbrella handles or an adapter such as adapter member 26. The lower end of receiving housing member 20 has a threaded bore 21. A camming lever 23 is provided to impart the necessary frictional force to either adapter member 26 or the umbrella handle being directly supported.

Adapter member 26 is basically a cylindrical body with a longitudinal axial opening 27 starting from its upper end and of such predetermined diameter to cooperatively receive umbrella handles of popular or standard diameters. A stopper ring 25 prevents adapter 26 from falling inside axial cavity 22 beyond the intended extent. Base assembly 40 includes flat stabilizing base member 42 which is preferably round and includes a central square opening 44 and two opposing threaded holes 46 and 48 substantially adjacent to the periphery of the base member. Pin members 52 and 54 include a mating threaded termination that cooperates with holes 46 and 48 to rigidly and perpendicularly mount pin members 52 and 54 on base member 42 to impart the necessary torque to drive helical assembly 60 into the ground or sand.

Helical assembly 60 comprises an upper threaded termination 62 with a square base 64 that is received within square opening 44 so that the torque generated by pins 52 and 54 is effectively transmitted to helical assembly 60. Washer member 66 is mounted below nut member 64 and it is intended to act as a stopper for stabilizing base member 42. The lower end of helical assembly 60 includes helical or screw member 68 that is preferably made out of non-corrosive material such as plastic. Cover member 70 is used as a cover for storage and transportation. Cover member 70 has a tubular shape with a bottom surface, preferably, on one end.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A holder for umbrellas having an elongated and straight handle, comprising:

A. a cylindrical receiving assembly having upper and lower ends and said upper end including an axial opening for receiving said umbrella handle and said lower end including a threaded opening, and said receiving assembly further including a camming lever for releasably holding said umbrella handle in place;

B. a helical assembly having upper and lower terminations and said upper termination including a threaded portion for cooperatively mating with said threaded opening and said lower termination including a screw member, and said helical assembly further comprises and integral nut members at said upper terminations; and C. a substantially flat stabilizing base member removably sandwiched between said cylindrical receiving assembly and said helical assembly, and said base member including a central square opening sufficiently large to permit said upper threaded termination through and snuggly housing said nut member and a washer member rigidly mounted below said nut member thereby acting as a stopper in sandwiching said stabilizing base member between said cylindrical receiving assembly, and said base further including at least two threaded openings substantially adjacent to the periphery of said base member and further comprising at least two threaded pins for removably and cooperatively mounting in said threaded openings so that a torque can be imparted to said base member which in turn is transmitted to said helical assembly.

2. A holder for umbrellas having an elongated and straight handle, as set forth in claim 1 comprising:

D. an adapter member having substantially a cylindrical shape and upper and lower ends and said upper end including an axial opening having a diameter that cooperates with the diameter of said handle and said lower end having a diameter that snuggly fits in said axial opening of said cylindrical assembly.

3. The holder set forth in claim 2 wherein said adapter member includes a stopper ring mounted substantially at the center of said adapter member.

* * * * *